US012129728B2

(12) United States Patent
Ma et al.

(10) Patent No.: US 12,129,728 B2
(45) Date of Patent: Oct. 29, 2024

(54) DOWNHOLE BLOWOUT PREVENTER AND BLOWOUT PREVENTION OPERATION METHOD

(71) Applicants: CHINA PETROLEUM & CHEMICAL CORPORATION, Beijing (CN); SINOPEC PETROLEUM ENGINEERING TECHNOLOGY RESEARCH INSTITUTE CO., LTD., Beijing (CN)

(72) Inventors: Lanrong Ma, Beijing (CN); Lei Gu, Beijing (CN); Huibo Yin, Beijing (CN); Xiaozhi Zheng, Beijing (CN); Guangming Cheng, Beijing (CN); Yuequan Hou, Beijing (CN)

(73) Assignees: CHINA PETROLEUM & CHEMICAL CORPORATION, Beijing (CN); SINOPEC PETROLEUM ENGINEERING TECHNOLOGY RESEARCH INSTITUTE CO., LTD., Beijing (CN)

( * ) Notice: Subject to any disclaimer, the term of this patent is extended or adjusted under 35 U.S.C. 154(b) by 0 days.

(21) Appl. No.: 18/254,420

(22) PCT Filed: Aug. 16, 2021

(86) PCT No.: PCT/CN2021/112796
§ 371 (c)(1),
(2) Date: May 25, 2023

(87) PCT Pub. No.: WO2022/127155
PCT Pub. Date: Jun. 23, 2022

(65) Prior Publication Data

US 2024/0003215 A1 Jan. 4, 2024

(30) Foreign Application Priority Data

Dec. 17, 2020 (CN) ..... 202011495723.5

(51) Int. Cl.
*E21B 33/06* (2006.01)
*E21B 23/04* (2006.01)

(52) U.S. Cl.
CPC ..... *E21B 33/06* (2013.01); *E21B 23/0413* (2020.05)

(58) Field of Classification Search
CPC ..... E21B 33/06; E21B 23/0413
See application file for complete search history.

(56) References Cited

U.S. PATENT DOCUMENTS 3,533,468 A 10/1970 Lewis et al.
3,746,097 A 7/1973 Mott
(Continued)

FOREIGN PATENT DOCUMENTS

CN 101812981 A 8/2010
CN 201599007 U 10/2010
(Continued)

*Primary Examiner* — Taras P Bemko
(74) *Attorney, Agent, or Firm* — NKL Law; Allen Xue

(57) ABSTRACT

A downhole blowout preventer has a blowout preventer tubing string containing a circulation unit, a packer unit and a pressure-building unit connected in sequence from top to bottom. The pressure-building unit is configured to be activated in response to a command, so as to build up pressure in a space inside the blowout preventer tubing string. The packer unit is configured to be activated when a pressure in said space reaches a first predetermined value, so as to seal an annulus between said blowout preventer tubing string and an external casing or borehole. The circulation unit is configured to be activated when the pressure in said space reaches a second predetermined value, thereby creating a circulation path between an interior and an exterior of the blowout preventer tubing string. The first predetermined value is less than the second predetermined value.

18 Claims, 5 Drawing Sheets

(56) References Cited

U.S. PATENT DOCUMENTS

Figure 1:
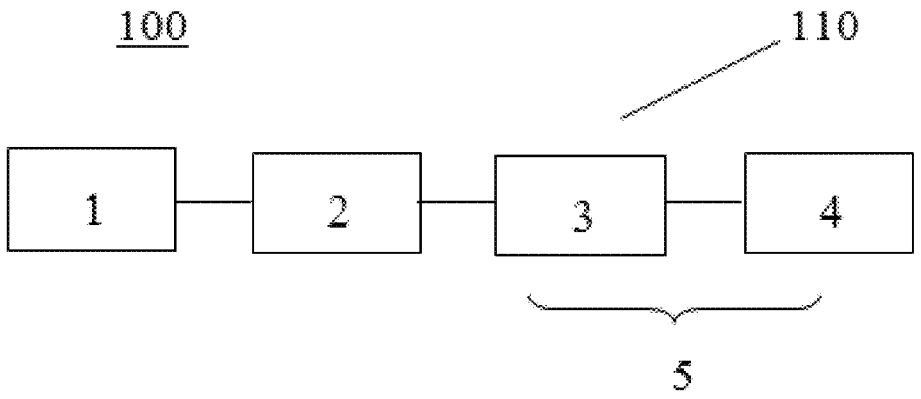

| | | | | | |
|---|---|---|---|---|---|
| 3,853,177 | A | | 12/1974 | Mott | |
| 3,908,769 | A | * | 9/1975 | Schuyf | E21B 33/127 175/48 |
| 3,941,190 | A | | 3/1976 | Conover | |
| 4,367,794 | A | | 1/1983 | Bednar et al. | |
| 4,588,035 | A | | 5/1986 | Van Gils et al. | |
| 4,712,613 | A | * | 12/1987 | Nieuwstad | E21B 33/127 166/321 |
| 4,905,958 | A | * | 3/1990 | Askelund | E21B 21/10 251/1.2 |
| 5,404,953 | A | * | 4/1995 | Sangesland | E21B 21/103 175/243 |

FOREIGN PATENT DOCUMENTS

| | | | |
|---|---|---|---|
| CN | 201843563 | U | 5/2011 |
| CN | 201846563 | U | 5/2011 |
| CN | 201902192 | U | 7/2011 |
| CN | 102400662 | A | 4/2012 |
| CN | 202645490 | U | 1/2013 |
| CN | 103306634 | A | 9/2013 |
| CN | 203626793 | U | 6/2014 |
| CN | 204571908 | U | 8/2015 |
| CN | 207499840 | U | 6/2018 |
| CN | 111379536 | A | 7/2020 |

* cited by examiner

DOWNHOLE BLOWOUT PREVENTER AND BLOWOUT PREVENTION OPERATION METHOD

CROSS REFERENCE OF RELATED APPLICATION

This application is a U.S. national stage entry of PCT International Application No. PCT/CN2021/112796, filed on Aug. 16, 2021, which claims the priority of Chinese patent application No. 202011495723.5, entitled "Blowout preventer adopting composite setting mode" and filed on Dec. 17, 2020, the content of which is incorporated herein by reference in its entirety.

TECHNICAL FIELD

The present invention relates to drilling tools used in oil and gas fields, and specifically to a downhole blowout preventer. The present invention further relates to a blowout preventing operation method using such a downhole blowout preventer.

TECHNICAL BACKGROUND

In drilling operations for oil and gas production, when the pressure in the wellbore is less than the formation pressure, the fluid (i.e., oil, gas and water) in the downhole formation will enter the wellbore to cause overflow or well surge, resulting in drilling blowout and fire accidents in serious cases.

At present, the conventional method for handling the overflow or well surge is to provide a wellhead blowout preventer, by which the well is shut in to prevent the blowout, followed by a step of well killing. However, after the well is shut in, a large amount of high-pressure gas will migrate into the wellbore, causing the pressure in the casing to increase. This made it more difficult to perform the well-killing step, and the duration thereof is also prolonged.

U.S. Pat. No. 3,941,190 proposes a downhole blowout preventer, which includes an expandable packer for achieving sealing inside the drilling column. CN 201843563U discloses a mechanical downhole internal-and-external integral blowout preventer, which includes an arrow-type check valve and an external annulus packer, for achieving sealing between the internal and external annuluses of the downhole drill pipe.

However, the aforementioned downhole blowout preventers can only achieve simple sealing, which cannot adapt to variable downhole conditions, and also present poor stability.

SUMMARY OF THE INVENTION

Aiming at the above technical problems existing in the prior arts, one object of the present invention is to propose a downhole blowout preventer, which is capable of adopting two different seating modes for two different procedures, i.e., tripping and drilling respectively, so as to achieve reliable seating. Another object of the present invention is to provide a downhole blowout preventing operation method.

According to a first aspect of the present invention, a downhole blowout preventer is provided, comprising a blowout preventer tubing string, said blowout preventer tubing string comprising a circulation unit, a packer unit and a pressure-building unit connected in sequence from top to bottom. Said pressure-building unit is configured to be activated in response to a command, so as to build up pressure in a space inside said blowout preventer tubing string. Said packer unit is configured to be activated when a pressure in said space reaches a first predetermined value, so as to seal an annulus between said blowout preventer tubing string and an external casing or borehole. Said circulation unit is configured to be activated when the pressure in said space reaches a second predetermined value, thereby creating a circulation path between an interior and an exterior of said blowout preventer tubing string, said first predetermined value being less than said second predetermined value.

According to an embodiment of the present invention, said pressure-building unit comprises a ball-dropping and pressure-building device, and a mechanical pressing device arranged downstream of said ball-dropping and pressure-building device.

According to an embodiment of the present invention, said command is an operation of throwing a ball into said blowout preventer tubing string when a downhole overflow occurs during tripping, or an operation of pressing down said mechanical pressing device when a downhole overflow occurs during drilling.

According to an embodiment of the present invention, said mechanical pressing device comprises a pressing sleeve, a retaining sleeve arranged outside of said pressing sleeve, and a pivotable gate plate mechanism. Said pressing sleeve being configured to: maintain contact with said gate plate mechanism in an initial state, so as to press said gate plate mechanism against an inner wall of said retaining sleeve; and release contact with said gate plate mechanism in a pressing state, so that said gate plate mechanism is able to pivot under a resilient restoring force to close a flow channel in said blowout preventer tubing string for pressure building-up.

According to an embodiment of the present invention, said gate plate mechanism comprises a gate plate holder fixedly attached to an inner wall of said retaining sleeve, a gate plate pivotably attached to said gate plate holder through a pivot, and a torsion spring for providing said resilient restoring force.

According to an embodiment of the present invention, said mechanical pressing device further comprises a pressing section located at a lower end of said pressing sleeve, said pressing section being connected to said retaining sleeve through a second shear pin, and located at a radially inner side of said gate plate to contact with said gate plate mechanism in said initial state, said second shear pin having a shear stress less than said first predetermined value. After said second shear pin is sheared off in said pressing state, said pressing section moves downward by gravity, so that the contact between said pressing section and said gate plate mechanism is released, thereby allowing said gate plate mechanism to pivot.

According to an embodiment of the present invention, said pressing section is connected to an intermediate sleeve fixed to the inner wall of said retaining sleeve with said second shear pin, said intermediate sleeve being provided above said gate plate.

According to an embodiment of the present invention, said gate plate holder is provided with an inward step extending radially at a bottom end thereof, for receiving said pressing section.

According to an embodiment of the present invention, said packer unit comprises a central tube having a central passage, and an expandable rubber arranged on said central tube. A fluid reservoir is formed between said central tube and the rubber, and a pressure-transmitting hole is formed in said central tube for connecting said fluid reservoir with said central passage.

According to an embodiment of the present invention, a one-way valve is provided in said pressure-transmitting hole, and configured to allow fluid flow only in a direction from said central passage to said fluid reservoir.

According to an embodiment of the present invention, said central tube further comprises a pressure relief hole, which is configured to be located below said fluid reservoir in the initial state, but in communication with said fluid reservoir after moving upward with said central tube when said blowout preventer tubing string is lifted up.

According to an embodiment of the present invention, said circulation unit comprises a body having a circulation hole, and a differential sliding sleeve connected in said body through a first shear pin, said first shear pin having a shear stress equal to said second predetermined value. Said differential sliding sleeve is configured to block said circulation hole in the initial state, and move downward to open said circulation hole when the pressure in said blowout preventer tubing string exceeds said second predetermined value to shear off said first shear pin.

According to an embodiment of the present invention, said body is provided with an inner step on an inner side thereof, and said differential sliding sleeve is provided with an outer step on an outer wall thereof, said inner step being engageable with said outer step to restrict a downward movement of said differential sliding sleeve.

According to an embodiment of the present invention, said ball-dropping and pressure-building device comprises a ball, which is pre-built in the blowout preventer tubing string and supported on an automatic dropping mechanism. Said automatic dropping mechanism is actuated automatically in response to an indication signal, thereby allowing said ball to fall and engage with a ball seat of said ball-dropping and pressure-building device.

According to an embodiment of the present invention, said indication signal is a pressure wave signal.

According to a second aspect of the present invention, a blowout preventing operation method is provided, comprising steps of: lowering a downhole blowout preventer with a tubing column into a wellbore, wherein said downhole blowout preventer comprises a blowout preventer tubing string, said blowout preventer tubing string comprising a circulation unit, a packer unit, a ball-dropping and pressure-building device, and a mechanical pressing device, which are connected in sequence from top to bottom; performing pressure building-up through actuating the ball-dropping and pressure-building device by throwing a ball into said blowout preventer tubing string in the event that a downhole overflow occurs during tripping, or pressing said mechanical pressing device in the event that a downhole overflow occurs during drilling; actuating said packer unit when a pressure inside said blowout preventer tubing string reaches a first predetermined value, to seal an annulus between said blowout preventer tubing string and an external casing or borehole; actuating said circulation unit when the pressure inside said blowout preventer tubing string reaches a second predetermined value, to create a circulation path between an interior and an exterior of said blowout preventer tubing string; and performing a well killing operation.

According to an embodiment of the present invention, said method further comprises lifting up, after the well killing operation, said blowout preventer tubing string to form a communication between said pressure relief hole and the fluid reservoir, for completion of releasing.

According to an embodiment of the present invention, pressing said mechanical pressing device comprises applying a pressure to shear off said second shear pin, so that the pressing section of said mechanical pressing device moves downward away from said gate plate, whereby said gate plate rotates inward to completely cut off the flow channel in the blowout preventer tubing string.

According to an embodiment of the present invention, said mechanical pressing device is lifted up after said second shear pin is sheared off, in order to reset said pressing sleeve.

Figure 2:
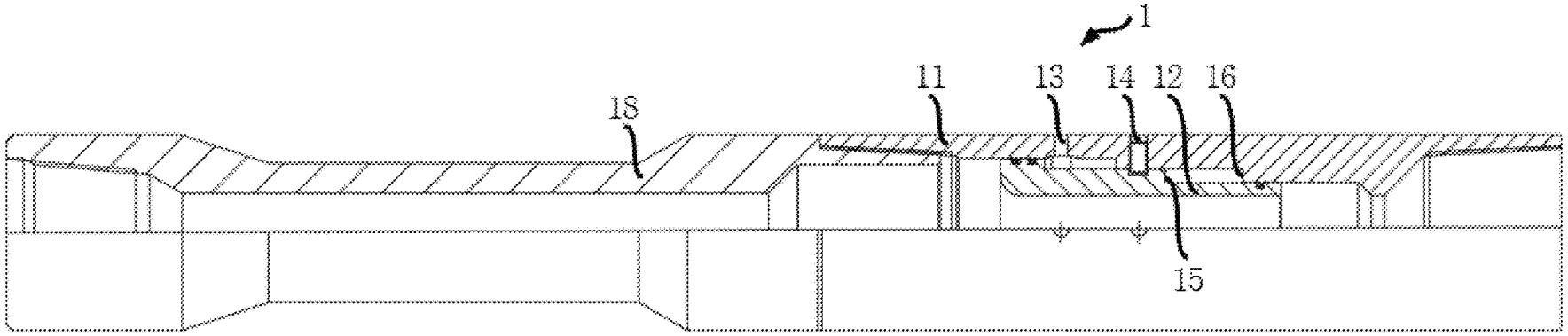
Figure 3:
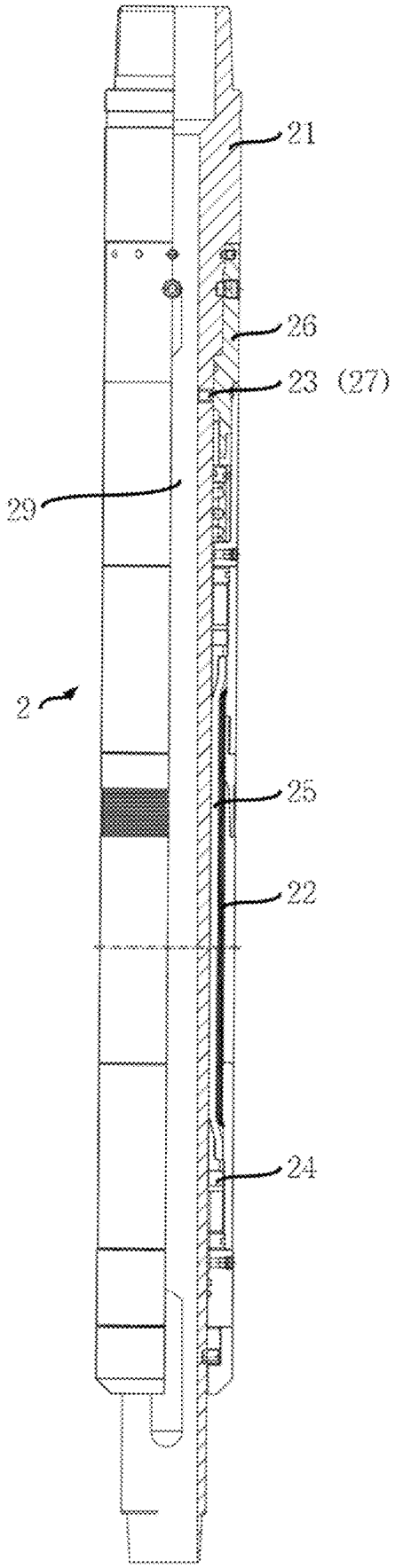
Figure 4:
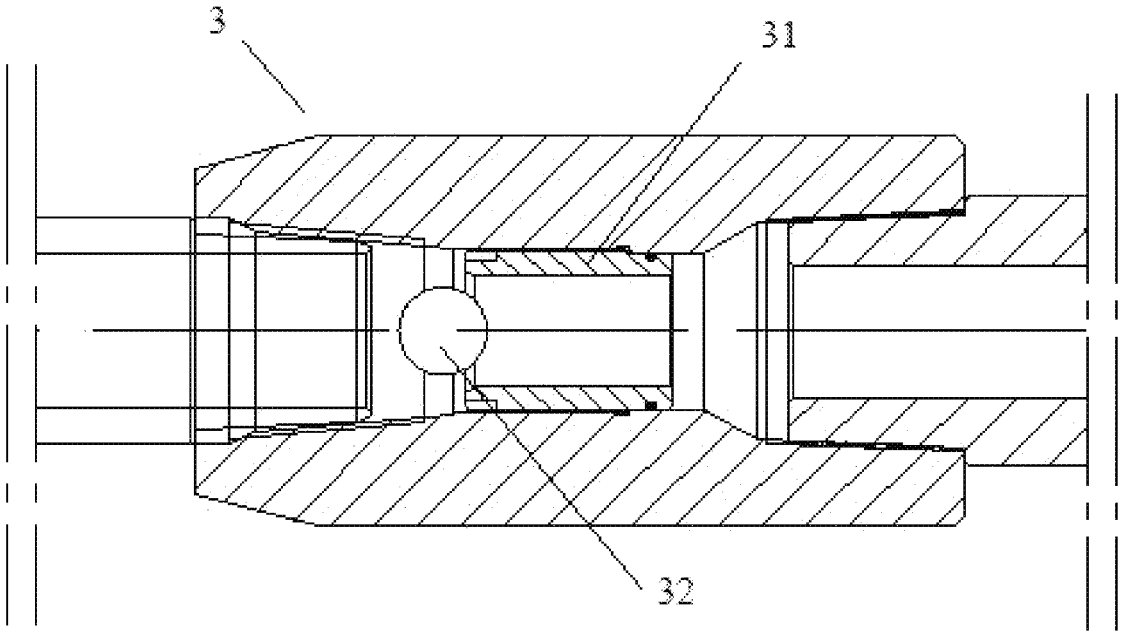
Figure 5:
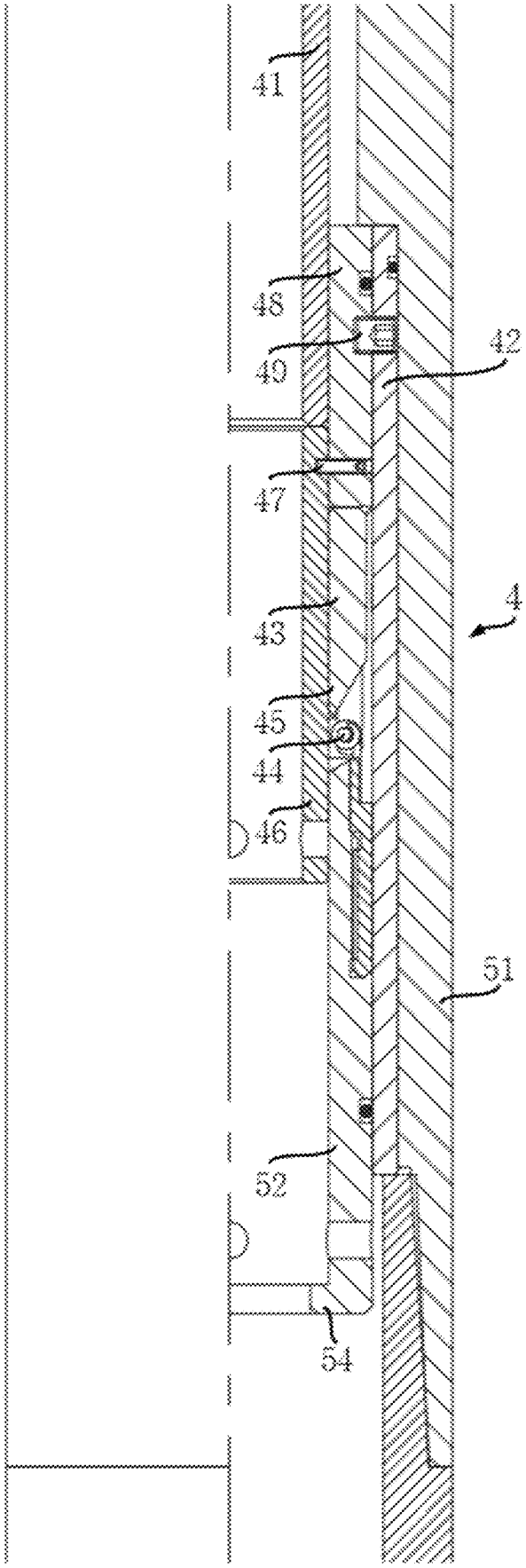

BRIEF DESCRIPTION OF THE DRAWINGS in the following preferred embodiments of the present invention will be described in detail with reference to the accompanying drawings. In the drawings:

FIG. 1 schematically shows the overall structure of a downhole blowout preventer according to an embodiment of the present invention;

FIG. 2 schematically shows the structure of a circulation unit in the downhole blowout preventer as shown in FIG. 1;

FIG. 3 schematically shows the structure of a packer unit in the downhole blowout preventer as shown in FIG. 1;

FIG. 4 schematically shows the structure of a ball-dropping and pressure-building device in the downhole blowout preventer as shown in FIG. 1; and FIG. 5 schematically shows the structure of a mechanical pressing device in the downhole blowout preventer as shown in FIG. 1.

In the drawings, the same reference numerals are used to indicate the same components. The drawings are not necessarily drawn to actual scale.

DETAILED DESCRIPTION OF EMBODIMENTS

The present invention will be further described below with reference to the accompanying drawings. In the context, directional terms "down", "downstream", "downward" or the like refer to a direction away from the well head, while directional terms "upper", "upstream", "upward" or the like refer to a direction toward the well head; the terms "longitudinal", "axial" or the like refer to a direction along the length of the downhole blowout preventer, while the terms "transverse", "radial" or the like refer to a direction perpendicular to the length of the downhole blowout preventer; and the terms "inner", "inward" or the like refer to a radial direction from the wellbore or the casing toward the center of the downhole blowout preventer, while the terms "outer", "outward" or the like refer to a radial direction from the center of the downhole blowout preventer toward the wellbore or the casing.

FIG. 1 schematically shows the overall structure of a downhole blowout preventer 100 according to an embodiment of the present invention. The downhole blowout preventer 100 comprises a blowout preventer tubing string 110 consisting of a plurality of functional units connected in sequence. Along a direction from upstream to downstream, the blowout preventer tubing string 110 comprises a circulation unit 1, a packer unit 2, and a pressure-building unit 5. Each of these functional units will be described in detail below.

As shown in FIG. 1, the circulation unit 1 is arranged in an upper part of the blowout preventer tubing string 110. The circulation unit 1 is configured to be activated at a certain pressure, thereby creating a circulation path between the interior and exterior of the blowout preventer tubing string 110.

FIG. 2 schematically shows the structure of the circulation unit 1 of the downhole blowout preventer 100 according to the present invention. As shown in FIG. 2, the circulation unit 1 comprises a body 11, which is formed as having a structure of a hollow tubular section. The body 11 is provided with a circulation hole 13 in an outer wall thereof, and can be connected to other tubing subs through an upper joint 18 arranged at an upstream end thereof. A differential sliding sleeve 12 is provided inside the body 11. In an initial state as shown in FIG. 2, the differential sliding sleeve 12 is fixed to the body 11 through a first shear pin 14, and thus blocks the circulation hole 13. During pressure building-up, when the pressure in the blowout preventer tubing string 110 is greater than the shear stress of the first shear pin 14, the first shear pin 14 is sheared off, so that the differential sliding sleeve 12 moves downstream under the pressure to open the circulation hole 13. Accordingly, communication between the interior and the exterior of the blowout preventer tubing string 110 (i.e., an annulus between the downhole blowout preventer 100 and an external casing not shown) is established.

In a preferred embodiment, an area of an upper end face of the differential sliding sleeve 12 is different from that of a low end face of the differential sliding sleeve 12, wherein the area of the upper end face is greater than that of the lower end face. With the end faces of different areas, it is possible to create a pressure difference between the upper and lower end faces of the differential sliding sleeve 12. After the first shear pin 14 is sheared off, this pressure difference will exert a downward force on the differential sliding sleeve 12 and thus urge the differential sliding sleeve 12 to move downstream, thereby opening the circulation hole 13. In this manner, communication between the interior and the exterior of the blowout preventer tubing string 110 is established.

As shown in FIG. 1, the packer unit 2 of the blowout preventer tubing string 110 is located downstream of the recirculation unit 1. The packer unit 2 is capable of being seated under a certain pressure, thus sealing the annulus between the blowout preventer tubing string 110 and the external casing (not shown). According to the present invention, the seating pressure of the packer unit 2 is less than the actuating pressure of the circulation unit 1 (i.e., the shear stress of the first shear pin 14), in order to ensure that the circulation unit 1 will not be actuated before the packer unit 2 is seated.

FIG. 3 schematically shows the structure of the packer unit 2 of the downhole blowout preventer 100 according to the present invention. As shown in FIG. 3, the packer unit 2 comprises a central tube 21, and an expandable rubber 22 arranged on the central tube 21. The central tube 21 is formed as a hollow tube defining a central passage 29. A fluid reservoir 25 is formed between the central tube 21 and the rubber 22. A radially extending pressure-transmitting hole 23 formed in the central tube 21 connects the fluid reservoir 25 and the central passage 29 of the central tube 21. In the preferred embodiment shown in FIG. 3, the pressure-transmitting hole 23 is configured to be in communication with an upper part of the fluid reservoir 25. Depending on the actual needs, a packer housing 26 may also be provided outside of the central tube 21.

Moreover, in a preferred embodiment, the rubber 22 is provided with teeth (not shown) on its outer surface, for better engagement with the external casing after expansion of the rubber 22, thus creating a reliable seating.

According to the present invention, a one-way valve 27 is provided in the pressure-transmitting hole 23. The one-way valve 27 is configured to allow fluid to flow only in a direction from the central passage 29 of the central tube 21 to the fluid reservoir 25 formed between the central tube 21 and the rubber 22 (i.e., radially from inside to outside), but not in a direction from the fluid reservoir 25 to the central passage 29 (i.e., radially from outside to inside).

In this way, when pressure is building up within the blowout preventer tubing string 110, fluid in a flow channel within the blowout preventer tubing string 110 can enter the fluid reservoir from the central passage 29 of the central tube 21 via the pressure-transmitting hole 23, thereby forcing the expandable rubber 22 to expand radially outward. Finally, a firm snap engagement can be formed between the teeth of the rubber 22 and the casing, thus achieving the seating.

According to the present invention, because of existence of the one-way valve 27, fluid entering into the fluid reservoir 25 cannot flow back through the pressure-transmitting hole 23 even after the pressure is relieved, thus ensuring the packer unit 2 remains seated.

In a preferred embodiment, a pressure relief hole 24 is further provided in the central tube 21. When the downhole blowout preventer 100 is in its initial state, the pressure relief hole 24 is located below the fluid reservoir 25 and is therefore not in communication with the fluid reservoir 25. When the seating is to be released after completion of the well killing operation, the blowout preventer tubing string 110 can be lifted up. Since the rubber 22 is in a seated state, both the rubber 22 and the packer housing 26 (if any) remain stationary, but the central tube 21 will move upward with the blowout preventer tubing string 110, causing the pressure relief hole 24 to move upward relative to the fluid reservoir 25. When the pressure relief hole 24 comes to a position corresponding to the fluid reservoir 25, the fluid in the fluid reservoir 25 will be discharged through the pressure relief hole 24, thus achieving the releasing.

As shown in FIG. 1, the blowout preventer tubing string 110 further includes a pressure-building unit 5 arranged downstream of the packer unit 2. According to the present invention, in order to adapt to different downhole operation stages, the pressure-building unit 5 of the downhole blowout preventer 100 according to the present invention includes a ball-dropping and pressure-building device 3, and a mechanical pressing device 4. Preferably, the ball-dropping and pressure-building device 3 is located upstream of the mechanical pressing device 4.

FIG. 4 schematically shows the ball-dropping and pressure-building device 3 of the downhole blowout preventer 100 according to the present invention. The ball-dropping and pressure-building device 3 includes a ball seat 31. When it is required to throw a ball and build up pressure, a ball 32 is thrown from the wellhead to engage with the ball seat 31, thereby enabling pressure building-up within the blowout preventer tubing string 110. This structure is well known to those skilled in the art, and its detailed description is omitted here.

In an embodiment not shown, the ball 32 may be arranged at an upstream position in the downhole blowout preventer 100 in advance, and thrown down by an automatic dropping mechanism. Specifically, in the initial state, the ball 32 is located at a suitable location above the ball seat 31 in the blowout preventer tubing string 110 including the automatic dropping mechanism. When needed, a throwing signal is sent from the ground and then received by the automatic dropping mechanism, which will be automatically actuated to throw down the ball 32 to engage with the ball seat 31. In this way, the time from ball dropping to seating can be shortened, thus improving the speed of the ball dropping and seating mode. Preferably, the throwing signal is a pressure wave signal, and the automatic dropping mechanism is configured to be actuated in response to the pressure wave signal.

FIG. 5 schematically shows the structure of the mechanical pressing device 4 of the downhole blowout preventer 100 according to the present invention. As shown in FIG. 5, the mechanical pressing device 4 includes a pressing housing 51, which has an upper end and a lower end connected to the ball-dropping and pressure-building device 3 and other subs in the tubing column, respectively. This connection can be direct or through a suitable joint. A retaining sleeve 42 is fixedly attached to the interior of the pressing housing 51, with axial positions thereof being defined, for example, by internal steps and joints of the pressing housing 51. It is readily understood that in an embodiment not shown, the retaining sleeve 42 and the pressing housing 51 may be formed as one piece.

A pressing sleeve 41 is arranged inside the retaining sleeve 42, and a gate plate mechanism is arranged between the pressing sleeve 41 and the retaining sleeve 42. The gate plate mechanism 45 includes a gate plate holder 52 fixedly attached to the retaining sleeve 42, and a gate plate 43 provided at an upper end of the gate plate holder 52. The gate plate 43 is pivotally attached to the gate plate holder 52 through a pivot 44, and thus has two positions, i.e., a first position wherein the gate plate 43 is pressed against an inner wall of the retaining sleeve 42 (as shown in FIG. 5), and a second position wherein the gate plate 43 rotates inwardly to cut off the central passage of the blowout preventer tubing string 110 (not shown). The pressing sleeve 41 is arranged on the inner side of the gate plate 43. A torsion spring (not shown) is arranged on the outer side of the gate plate 43, for providing an inward rotating force to the gate plate 43.

When the downhole blowout preventer 100 is in the initial state, the pressing sleeve 41 is located at the inner side of the gate plate 43, thereby blocking the inward rotation of the gate plate 43. At this time, the gate plate 43 is in the first position. After the blowout preventer tube string 110 is pressed down, the pressing sleeve 41 moves downward to leave its initial position corresponding to the gate plate 43. Thus, the gate plate 43 rotates inward about the pivot 44 under the action of the torsion spring, thereby completely cutting off the central passage of the blowout preventer tubing string 110. At this time, the gate plate 43 is in the second position. In this case, the pressure can be built up in a space in the blowout preventer tubing string 110 above the gate plate 43.

As shown in FIG. 5, in a preferred embodiment, a pressing section 46 is attached to a lower end of the pressing sleeve 41. The pressing section 46 is located on a radially inner side of the gate plate 43, in order to block the gate plate 43 to move. The pressing section 46 is fixedly connected to the retaining sleeve 42 by a second shear pin 47, and has an upper end in engagement with the lower end of the pressing sleeve 41. When the blowout preventer tube string 110 is pressed down, the second shear pin 47 is sheared off when the downward pressure reaches a predetermined threshold, so that the pressing section 46 is no longer fixedly connected to the retaining sleeve 42.

Therefore, the pressing section 46 will move downward by gravity. At this time, due to the downward movement of the pressing section 46 away from the gate plate 43, the gate plate 43 can rotate inward about the pivot 44 under the action of the torsion spring 45, thereby completely cutting off the flow channel in the blowout preventer tubing string 110.

According to the present invention, an inward step 54 extending radially is formed at a bottom end of the gate plate holder 52. In this manner, when the pressing section 46 moves downward by gravity, the lower end of the pressing section 46 will come into engagement with the step 54, thereby preventing further downward movement of the pressing section 46.

In the specific embodiment shown in FIG. 5, an intermediate sleeve 48 is further provided between the pressing section 46 and the retaining sleeve 42 and above the gate plate 43. The intermediate sleeve 48 is fixedly connected to the retaining sleeve 42, for example, through a fixing pin 49, while the pressing section 46 is fixedly connected to the intermediate sleeve 48 through the second shear pin 47. By means of the intermediate sleeve 48, the structure can be simplified and easy to replace.

It should be noted that some joints for connecting the above components with each other and with other subs of the tubing column are not shown in FIGS. 4 and 5, for the sake of keeping the drawings clear.

In the following a method of handling downhole overflow with the downhole blowout preventer 100 according to the present invention will be described briefly. It should be noted that the term "overflow" used here also includes "well surge", "blowout", and all other situations where a blowout preventer is required.

The downhole blowout preventer 100 according to the present invention is lowered into the wellbore along with a drilling tubing column (not shown). When a downhole overflow occurs during the tripping procedure, the ball-dropping and pressure-building device 3 of the pressure-building unit 5 is activated through dropping a ball into the wellbore, thereby initiating the pressure building-up procedure. When the pressure above the ball-dropping and pressure-building device 3 is increased to a first predetermined value, the fluid entering the fluid reservoir 25 via the pressure-transmitting hole 23 of the central tube 21 can sufficiently drive the rubber 22 to expand radially outward, thereby achieving seating. In this way, the packer unit 2 seals the annulus between the blowout preventer tubing string 110 and the casing (or the borehole). When the pressure is continuously increased to a second predetermined value, the first shear pin 13 in the circulation unit 1 is sheared off, so that the differential sliding sleeve 11 of the circulation unit 1 moves downward to open the circulation hole 13, thereby achieving the communication between the interior of the blowout preventer tubing string 110 and the exterior annulus. In this case, the well killing operation can be performed.

When downhole overflow occurs during drilling, the pressing sleeve 41 of the mechanical pressing device 4 is pressed down in a mechanical manner. When the pressure is increased to a certain threshold, the second shear pin 47 is sheared off, so that the pressing section 46 moves downward, enabling the gate plate 43 to rotate inward about the pivot 44 under the action of the torsion spring 45, thus completely cutting off the central passage of the blowout preventer tubing string 110. At this point, the pressure building-up procedure can begin. When the pressure above the mechanical pressing device 4 is increased to the first predetermined value, the fluid entering the fluid reservoir 25 via the pressure-transmitting hole 23 of the central tube 21 can sufficiently drive the rubber 22 to expand radially outward, thereby achieving seating. In this way, the packer unit 2 seals the annulus between the exterior of the blowout preventer tubing string 110 and the casing. When the pressure is continuously increased to the second predetermined value, the first shear pin 13 in the circulation unit 1 is sheared off, so that the differential sliding sleeve 11 of the circulation unit 1 moves downward to open the circulation hole 13, thereby achieving the communication between the interior of the blowout preventer tubing string 110 and the exterior annulus. In this case, the well killing operation can be performed.

After the well killing operation is performed, the blowout preventer tube string 110 is lifted up so that the central tube 21 moves upward accordingly, until the pressure relief hole 24 moves to the position corresponding to the fluid reservoir 25. At this point, the fluid in the fluid reservoir 25 can be discharged through the pressure relief hole 24, thereby completing the releasing.

It should be noted that after the second shear pin 47 is sheared off, the pressing section 46 will move downward by gravity. However, at this phase the pressing sleeve 41 will also move downward due to the downward pressure, and thus may move to a position radially inner of the gate plate 43, which will block the inward rotation of the gate plate 43. In such a case, the pressing sleeve 41 can be reset by lifting up the mechanical pressing device 4, so that the gate plate 43 can rotate inwardly freely.

Therefore, the downhole blowout preventer according to the present invention can handle overflow events through two different seating modes for two different procedures, i.e., tripping and drilling, respectively. In the procedure of drilling, as the drilling tool is in contact with the bottom of the well, the pressure building-up condition is established by the overall downward and upward movements of the drilling tool, thus achieving the seating of the downhole blowout preventer with the pressure building-up in the tubing. This mode is featured by fast action, reliable operation, and quick response to the well surge and overflow. In the procedure of tripping, as the drilling tool is far away from the bottom of the well, the pressure building-up condition is established by throwing a ball at this time, wherein the seating is generated through pressure building-up after the ball reaches the ball seat of the downhole blowout preventer. The operation of this mode is highly reliable. In addition, by using a pre-built ball and an automatic dropping mechanism, it is also possible to improve the speed of the ball-dropping mode.

The downhole blowout preventer according to the present invention can be used in combination with a conventional wellhead blowout preventer, thus providing double security for effectively handling overflow events.

Although the present invention has been described with reference to the preferred embodiments, one skilled in the art can make various modifications and/or improvements on these embodiments after understanding the basic creative conception of the present invention. Therefore, the appending claims are intended to be construed as covering the preferred embodiments and all modifications and/or improvements falling within the scope of the present invention. All the modifications and/or improvements made according to the embodiments of the present invention shall fall within the scope of the present invention.

The invention claimed is:

1. A downhole blowout preventer (100), comprising a blowout preventer tubing string (110), said blowout preventer tubing string (110) comprises a circulation unit (1), a packer unit (2) and a pressure-building unit (5) connected in sequence from top to bottom, wherein said pressure-building unit (5) is configured to be activated in response to a command, so as to build up pressure in a space inside said blowout preventer tubing string, said packer unit (2) is configured to be activated when a pressure in said space reaches a first predetermined value, so as to seal an annulus between said blowout preventer tubing string and an external casing or borehole, and said circulation unit (1) is configured to be activated when the pressure in said space reaches a second predetermined value, thereby creating a circulation path between an interior and an exterior of said blowout preventer tubing string, said first predetermined value being less than said second predetermined value, wherein said pressure-building unit comprises a ball-dropping and pressure-building device (3) and a mechanical pressing device (4) arranged downstream of said ball-dropping and pressure-building device.

2. The downhole blowout preventer according to claim 1, wherein said command is an operation of throwing a ball into said blowout preventer tubing string when a downhole overflow occurs during tripping, or an operation of pressing down said mechanical pressing device when a downhole overflow occurs during drilling.

3. The downhole blowout preventer according to claim 2, wherein said mechanical pressing device (4) comprises a pressing sleeve (41), a retaining sleeve (42) arranged outside of said pressing sleeve, and a pivotable gate plate mechanism (45), said pressing sleeve being configured to:

maintain contact with said gate plate mechanism in an initial state, so as to press said gate plate mechanism against an inner wall of said retaining sleeve; and release contact with said gate plate mechanism in a pressing state, so that said gate plate mechanism is able to pivot under a resilient restoring force to close a flow channel in said blowout preventer tubing string for pressure building-up.

4. The downhole blowout preventer according to claim 3, wherein said gate plate mechanism (45) comprises a gate plate holder (52) fixedly attached to an inner wall of said retaining sleeve, a gate plate (43) pivotably attached to said gate plate holder (52) through a pivot (44), and a torsion spring for providing said resilient restoring force.

5. The downhole blowout preventer according to claim 4, wherein said mechanical pressing device further comprises a pressing section (46) located at a lower end of said pressing sleeve, said pressing section being connected to said retaining sleeve (42) through a second shear pin (47), and located at a radially inner side of said gate plate (43) to contact with said gate plate mechanism in said initial state, said second shear pin having a shear stress less than said first predetermined value, and wherein after said second shear pin is sheared off in said pressing state, said pressing section moves downward by gravity, so that the contact between said pressing section and said gate plate mechanism is released, thereby allowing said gate plate mechanism to pivot.

6. The downhole blowout preventer according to claim 5, wherein said pressing section is connected to an intermediate sleeve (48) fixed to the inner wall of said retaining sleeve (42) with said second shear pin (47), said intermediate sleeve (48) being provided above said gate plate (43).

7. The downhole blowout preventer according to claim 5, wherein said gate plate holder (52) is provided with an inward step (54) extending radially at a bottom end thereof, for receiving said pressing section (46).

8. The downhole blowout preventer according to claim 1, wherein said packer unit (2) comprises a central tube (21)

having a central passage (29), and an expandable rubber (22) arranged on said central tube, wherein a fluid reservoir (25) is formed between said central tube and the rubber, and a pressure-transmitting hole (23) is formed in said central tube for connecting said fluid reservoir with said central passage.

9. The downhole blowout preventer according to claim 8, wherein a one-way valve (27) is provided in said pressure-transmitting hole (23), and configured to allow fluid flow only in a direction from said central passage (29) to said fluid reservoir (25).

10. The downhole blowout preventer according to claim 8, wherein said central tube further comprises a pressure relief hole (24), which is configured to be located below said fluid reservoir in the initial state, and to be in communication with said fluid reservoir after moving upward with said central tube when said blowout preventer tubing string is lifted up.

11. The downhole blowout preventer according to claim 1, wherein said circulation unit (1) comprises a body (11) having a circulation hole (13), and a differential sliding sleeve (12) connected in said body (11) through a first shear pin (14), said first shear pin having a shear stress equal to said second predetermined value, and wherein said differential sliding sleeve (12) is configured to block said circulation hole in the initial state, and move downward to open said circulation hole when the pressure in said blowout preventer tubing string exceeds said second predetermined value to shear off said first shear pin.

12. The downhole blowout preventer according to claim 11, wherein said body (11) is provided with an inner step (16) on an inner side thereof, and said differential sliding sleeve (12) is provided with an outer step (15) on an outer wall thereof, said inner step being engageable with said outer step to restrict a downward movement of said differential sliding sleeve (12).

13. The downhole blowout preventer according to claim 1, wherein said ball-dropping and pressure-building device (3) comprises a ball (32), which is pre-built in the blowout preventer tubing string (110) and supported on an automatic dropping mechanism, wherein said automatic dropping mechanism is actuated automatically in response to an indication signal, thereby allowing said ball (32) to fall and engage with a ball seat (31) of said ball-dropping and pressure-building device (3).

14. The downhole blowout preventer according to claim 13, wherein said indication signal is a pressure wave signal.

15. A blowout preventing operation method, comprising steps of:

lowering a downhole blowout preventer with a tubing column into a wellbore, wherein said downhole blowout preventer comprises a blowout preventer tubing string, said blowout preventer tubing string comprising a circulation unit, a packer unit, a ball-dropping and pressure-building device, and a mechanical pressing device, which are connected in sequence from top to bottom;

performing pressure building-up through actuating the ball-dropping and pressure-building device by throwing a ball into said blowout preventer tubing string in the event that a downhole overflow occurs during tripping, or pressing said mechanical pressing device in the event that a downhole overflow occurs during drilling;

actuating said packer unit when a pressure inside said blowout preventer tubing string reaches a first predetermined value, to seal an annulus between said blowout preventer tubing string and an external casing or borehole;

actuating said circulation unit when the pressure inside said blowout preventer tubing string reaches a second predetermined value, to create a circulation path between an interior and an exterior of said blowout preventer tubing string; and performing a well killing operation.

16. The blowout preventing operation method according to claim 15, further comprising: lifting up, after the well killing operation, said blowout preventer tubing string to form a communication between said pressure relief hole and the fluid reservoir, for completion of releasing.

17. The blowout preventing operation method according to claim 16, wherein pressing said mechanical pressing device comprises applying a pressure to shear off said second shear pin, so that the pressing section of said mechanical pressing device moves downward away from said gate plate, whereby said gate plate rotates inward to completely cut off the flow channel in the blowout preventer tubing string.

18. The blowout preventing operation method according to claim 17, wherein said mechanical pressing device is lifted up after said second shear pin is sheared off, in order to reset said pressing sleeve.

* * * * *